US006041641A

United States Patent [19]

Inagaki et al.

[11] Patent Number: 6,041,641

[45] Date of Patent: Mar. 28, 2000

[54] METHOD FOR WORKING GROOVE

[75] Inventors: Yoshio Inagaki, Aichi-ken; Takeshi Ito, Kasugai, both of Japan

[73] Assignee: TRW Steering Systems Japan Co., Ltd, Aichi-ken, Japan

[21] Appl. No.: 09/126,065

[22] Filed: Jul. 30, 1998

[30] Foreign Application Priority Data

Aug. 1, 1997 [JP] Japan ..... 9-208047

[51] Int. Cl.[7] ..... B21K 21/12

[52] U.S. Cl. ..... 72/370.21; 72/359

[58] Field of Search ..... 72/325, 370.1, 72/370.21, 359; 470/19, 88, 63

[56] References Cited

U.S. PATENT DOCUMENTS

| | | | |
|---|---|---|---|
| 1,314,668 | 9/1919 | Jaques, Jr. | 470/88 |
| 1,449,243 | 3/1923 | Peckham et al. | 470/88 |
| 1,905,621 | 4/1933 | Cole | 470/19 |
| 2,887,694 | 5/1959 | Sauter | 470/30 |

*Primary Examiner*—Lowell A. Larson

*Attorney, Agent, or Firm*—Tarolli, Sundheim, Covell, Tummino & Szabo L.L.P.

[57] ABSTRACT

A method for forming a groove by plastic deformation to provide improved working efficiency. A hole 4 having a diameter larger than a width W of a desired groove 6 and a depth deeper than the desired depth of the groove 6 is formed in an end face 2 of a rod 1. Subsequently, the groove 6 is formed by plastic deformation to partially overlap the hole 4. The plastic working to form the groove may be carried without the use of a die.

14 Claims, 3 Drawing Sheets

METHOD FOR WORKING GROOVE

BACKGROUND OF THE INVENTION

The present invention relates to a method for forming a groove in an end face of a rod of metal (e.g. iron).

When a groove 54 is formed in an end face 52 of a rod 50 as shown in FIG. 4A, the groove 54 is, in the prior art, formed by, for example, a cutting operation with a milling machine, or through plastic working with punch and die.

In such a conventional milling method, however, a long processing time is required and only a low yield is achieved. On the other hand, in the latter punch and die conventional method, as shown in FIG. 5, the rod 50 is inserted in a bore 57 of a die 56 and formed by a pair of punches 58 and 60 which are similarly inserted in the bore 57. Since the forming is performed in such an enclosed space, the life of a metal mold 56 is shortened, the frequency of replacement of the broken metal mold is increased and, thus, the working efficiency is low.

SUMMARY OF THE INVENTION

Wherefore, an object of the invention is to provide a method for forming a groove through plastic working with an improved operating efficiency.

According to the invention, there is provided a method for forming a groove in an end face of a rod, which comprises the steps of: forming in the end face of the rod a hole which has a diameter larger than a width of the desired groove and is deeper than the depth of the desired groove; and forming the groove partially overlapped with the hole, by plastic deformation, of material of the rod from the end face.

Also, according to the invention, there is provided a method for forming a groove in an end face of a rod, which comprises the steps of: cutting the rod to a desired length that considers the elongation resulting from a subsequent punching step; forging and plastically forming, with a punch, in an end face of the rod, a hole having a diameter larger than a width of the groove to be formed; and plastically deforming through the end face of the rod, using a punch configured to form the groove, the groove partially overlapping the hole.

Also, according to the invention, there is provided a method for forming a groove in an end face of a rod, which comprises the steps of: cutting the rod to a desired length that considers the elongation resulting from a subsequent punching step; making a hole by one of drilling and plastically deforming in an end face of the rod to form a hole having a diameter larger than a desired width of the groove; inserting the rod in a bore of a die for plastic working; and punching an opposite end face of the rod with a punch to force the front mentioned end face of the rod onto a shaped protrusion which passes along the center of the hole, thereby forming the groove.

BRIEF DESCRIPTION OF THE DRAWINGS

The invention will now be described, by way of example, with reference to the accompanying drawings, in which.

DETAILED DESCRIPTION OF THE PREFERRED EMBODIMENT

An embodiment of the invention will be described in detail with reference to the accompanying drawings.

Figure 1A:
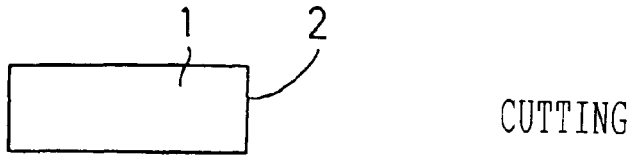
FIGS. 1A to 1C are explanatory views showing processes for forming a groove according to an embodiment of the invention.

First, as shown in FIG. 1A, a rod 1 is cut from a coil or a longitudinal material. The cut length is predetermined by considering the elongation resulting from a punching process hereinafter described.

Figure 1B:
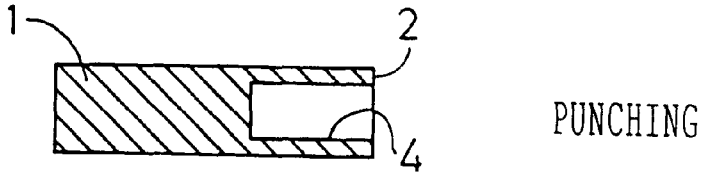
Figure 1C:
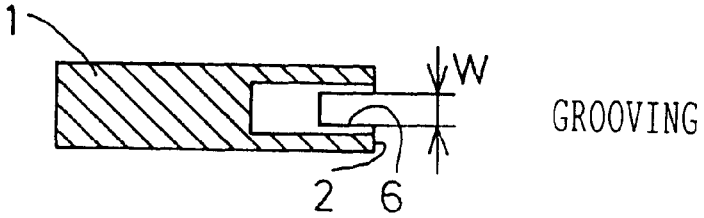

Subsequently, as shown in FIG. 1B, a hole 4 is punched in an end face 2 of the rod 1. The hole 4 is formed or sized to have a diameter larger than a width W of a groove 6 described later and a depth deeper than the groove 6. The hole 4 is formed larger than the groove 6 because the material displaced during the subsequent process of plastic working of the groove 6 is allowed to escape into the hole 4. It is preferable that the volume obtained by subtracting the volume by which the hole 4 and the groove 6 overlap each other from the volume of the hole 4 is equal to or larger than the volume of the material displaced by the plastic working of the groove 6.

Figure 2:
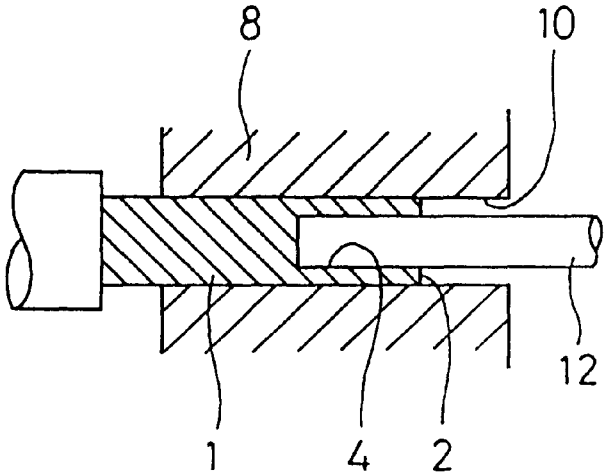
FIG. 2 is a sectional view showing a metal mold for punching in the embodiment of FIG. 1.

In the punching process, as shown in FIG. 2, the rod 1 is inserted in a bore 10 of a die 8, and the hole 4 is forged and plastically worked in the end face 2 of the rod 1 with a punch 12. The hole 4 may also be formed by drilling (not shown) or the like, but the plastic working process is simpler and quicker than the cutting operation.

Figure 3:
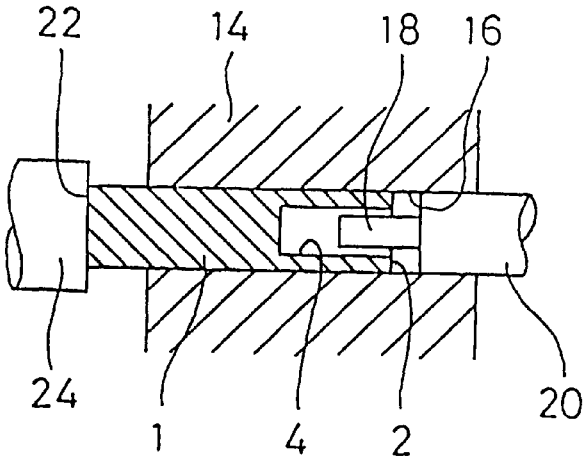
FIG. 3 is a sectional view showing a metal mold for forming a groove in the embodiment of FIG. 1.
Figure 4A:
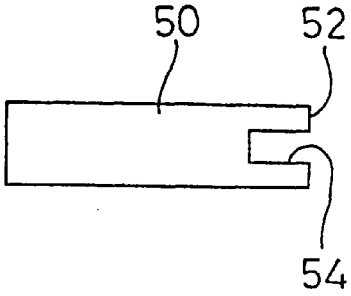
FIG. 4A PRIOR ART
FIG. 4A is a side view of a rod in which a groove has been formed.
Figure 4B:
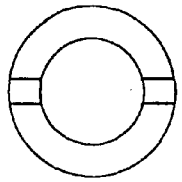
FIG. 4B PRIOR ART
FIG. 4B is an end elevation of a rod in which a slot is formed.
Figure 4C:
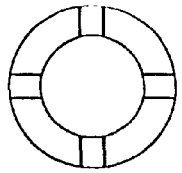
FIG. 4C PRIOR ART
FIG. 4C is an end elevation of a rod in which crossed grooves are formed.
Figure 5:
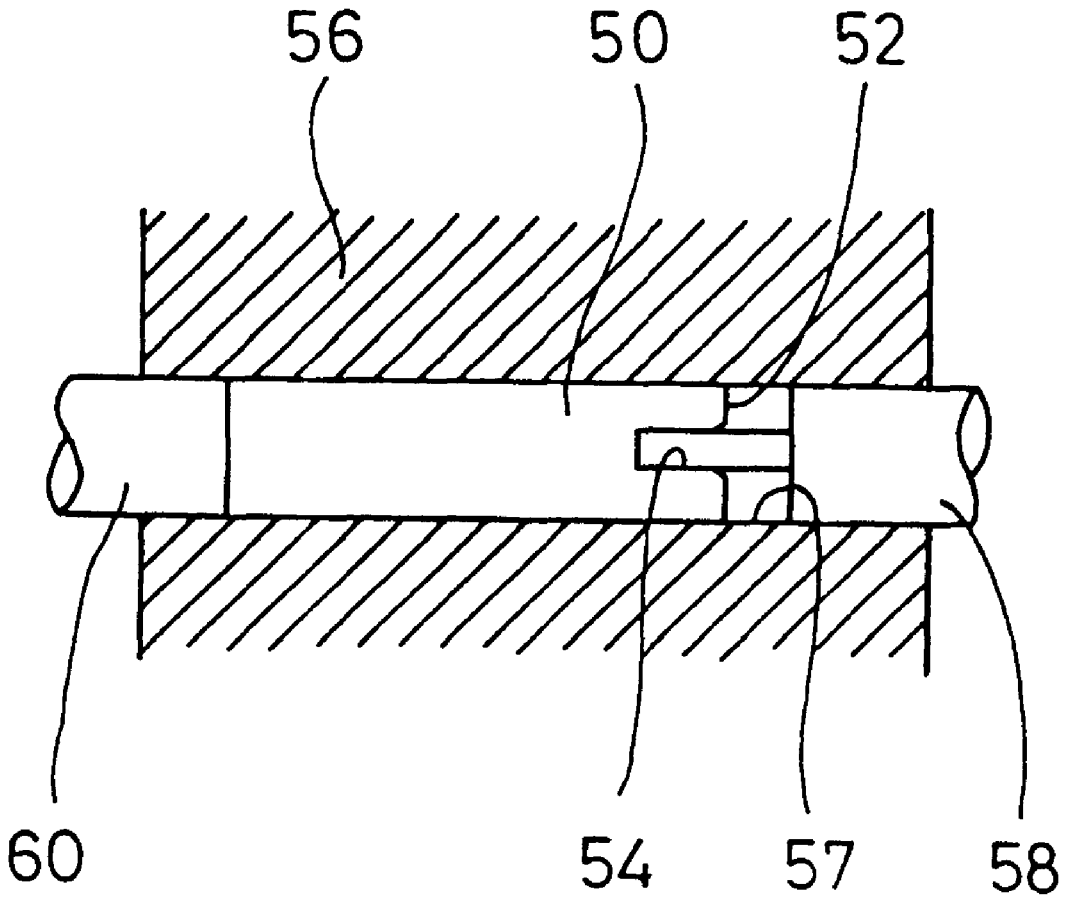
FIG. 5 PRIOR ART
FIG. 5 is a sectional view of a metal mold for forming a groove by a conventional prior art method.

After the punching process, a grooving process is performed. The groove 6 may be partially overlapped with the hole 4. Preferably, however, the groove 6 is worked to pass through the center of the hole 4. In the grooving process, as shown in FIG. 3, the rod 1 with the hole 4 made therein is inserted into a bore 16 of a die 14. Subsequently, a punch 20 having a protrusion 18 in accordance with dimensions of the groove 6 to be formed is pushed into the end face 2 from the end face 2 of the rod 1 to form the groove 6 in the end face 2. In this embodiment, the protrusion 18 has a rectangular configuration. However, the protrusion 18 is not limited to such a configuration (as shown in FIG. 4B) and may have, for example, a configuration of crossed grooves (as shown in FIG. 4C).

The plastic working of the groove 6 may be an open working which is performed just by supporting or pushing the end face 22, remote from the end face 2, of the rod 1 using a punch 24. Since the material displaced by the protrusion 18 can escape into the hole 4, the load applied at the time of molding can be relatively small. Further, the groove 6 can be formed without being worked in an enclosed bore. Consequently, since the groove 6 can be formed in the open, the life of the metal mold used to form the bore 4 is enhanced, the frequency of replacement of broken metal molds is decreased and operational efficiency can be enhanced. Furthermore, since the forming force is relatively small, the groove and end(s) of the material can be simultaneously worked. The plastic working processes used also increases the degree of design freedom.

The present invention is not limited to the embodiment mentioned above, and can be embodied variously within the scope of the invention.

What is claimed is:

1. A method comprising the steps of:

providing a rod having first and second opposite end faces;

forming a hole in said first end face of said rod which hole terminates short of said second end face of said rod, and thereafter forming a groove in said first end face of said rod by displacing material of said end face into said hole, said hole having a diameter which is larger than the width of said groove, said hole being deeper than the depth of said groove, said groove intersecting said hole and intersecting the outer perimeter of said rod.

2. The method according to claim 1 wherein said hole is formed by a cutting operation.

3. The method according to claim 1 wherein forming said groove results in the groove having a linear configuration.

4. The method according to claim 1 wherein forming said groove results in the groove having a crossed configuration.

5. A method comprising the steps of:

providing a rod having first and second opposite end faces;

forming a hole in said first end face of said rod by plastically deforming the material of said rod which hole terminates short of said second end face of said rod, and which plastic deformation elongates said rod, and thereafter forming a groove in said first end face of said rod by displacing material of said first end face into said hole, said hole having a diameter which is larger than the width of said groove, said hole being deeper than the depth of said groove, and said groove intersecting said hole and the outer perimeter of said rod.

6. The method according to claim 5 wherein forming said groove results in the groove having a linear configuration.

7. The method according to claim 5 wherein forming said groove results in the groove having a crossed configuration.

8. A method comprising the steps of:

providing a rod with first and second opposite end faces;

cutting said rod into a predetermined length;

plastically deforming a hole into said first end face of said rod with a punch which hole terminates short of said second end face of said rod, and which plastic deformation elongates said rod;

plastically deforming said groove into said first end face of a rod with a punch including a protrusion extending into said hole, said punch displacing material of said end face into said hole, and said hole having a diameter which is larger than the width of said groove, said groove intersecting said hole and the outer perimeter of said rod.

9. The method according to claim 8 wherein forming said groove results in the groove having a linear groove configuration.

10. The method according to claim 8 wherein forming said groove results in the groove having a crossed groove configuration.

11. The method according to claim 8 wherein the step of plastically forming the groove includes passing said punch along the center of the hole.

12. A method comprising the steps of:

providing a rod with first and second opposite end surfaces;

cutting said rod into a predetermined length;

plastically deforming a hole in said first end face of said rod which hole terminates short of said second end face of said rod, and which plastic deformation elongates said rod, said hole having a diameter which is larger than the width of a groove, and thereafter inserting said rod in a bore of a die for plastic working, and thereafter forming a groove by punching said second end face of said rod with a punch, said punch forcing said first end face into a shaped protrusion which passes along the center of said hole.

13. The method according to claim 12 wherein the first end face is punched into the shaped protrusion having a linear configuration.

14. The method according to claim 12 wherein the first end face is punched into the shaped protrusion having a crossed configuration.

* * * * *